US010109130B2

(12) United States Patent
Kulikovsky et al.

(10) Patent No.: US 10,109,130 B2
(45) Date of Patent: Oct. 23, 2018

(54) METHOD AND DEVICE FOR TESTING A SECURITY ELEMENT OF A SECURITY DOCUMENT

(71) Applicant: Bundesdruckerei GmbH, Berlin (DE)

(72) Inventors: Lazar Kulikovsky, Berlin (DE); Manfred Paeschke, Wandlitz (DE); Jörg Fischer, Berlin (DE); Olga Kulikovska, Berlin (DE); Detlef Starick, Berlin (DE)

(73) Assignee: BUNDESDRUCKEREI GmbH, Berlin (DE)

( * ) Notice: Subject to any disclaimer, the term of this patent is extended or adjusted under 35 U.S.C. 154(b) by 393 days.

(21) Appl. No.: 14/912,144

(22) PCT Filed: Aug. 14, 2014

(86) PCT No.: PCT/EP2014/067402
§ 371 (c)(1),
(2) Date: Feb. 15, 2016

(87) PCT Pub. No.: WO2015/022394
PCT Pub. Date: Feb. 19, 2015

(65) Prior Publication Data

US 2016/0203665 A1 Jul. 14, 2016

(30) Foreign Application Priority Data

Aug. 16, 2013 (DE) ..... 10 2013 216 308

(51) Int. Cl.
*G07D 7/00* (2016.01)
*G07D 7/12* (2016.01)

(52) U.S. Cl.
CPC ..... *G07D 7/003* (2017.05); *G07D 7/12* (2013.01)

(58) Field of Classification Search
CPC ..... G07D 7/003; G07D 7/12
(Continued)

(56) References Cited

U.S. PATENT DOCUMENTS 4,526,466 A 7/1985 Sandercock
6,473,165 B1 10/2002 Coombs et al.
(Continued)

FOREIGN PATENT DOCUMENTS

DE 102007063415 A1 6/2009
EP 1028359 A1 8/2000
(Continued)

*Primary Examiner* — Hina F Ayub
*Assistant Examiner* — Amanda Merlino
(74) *Attorney, Agent, or Firm* — Frank J. Bonini, Jr.; John F. A. Earley, III; Harding, Earley, Follmer & Frailey, P.C.

(57) ABSTRACT

Method and device for testing a security element (4) of a security document, the security element (4) being able to contain at least one substance (5) which has optically variable properties, including the following method steps: illuminating the security element (4) with at least one predetermined illumination parameter, filtering the light reflected by the security element into a first component (RLp) having a first polarisation, determining an intensity (I) of the first component (RLp) of reflected light reflected at a reflection angle ($\phi_R$), for at least one reflection angle ($\phi_R$), and verifying the presence of a substance (5) which has optically variable properties as a function of the intensity (I) of the first component (RLp).

23 Claims, 5 Drawing Sheets

Figure 1:
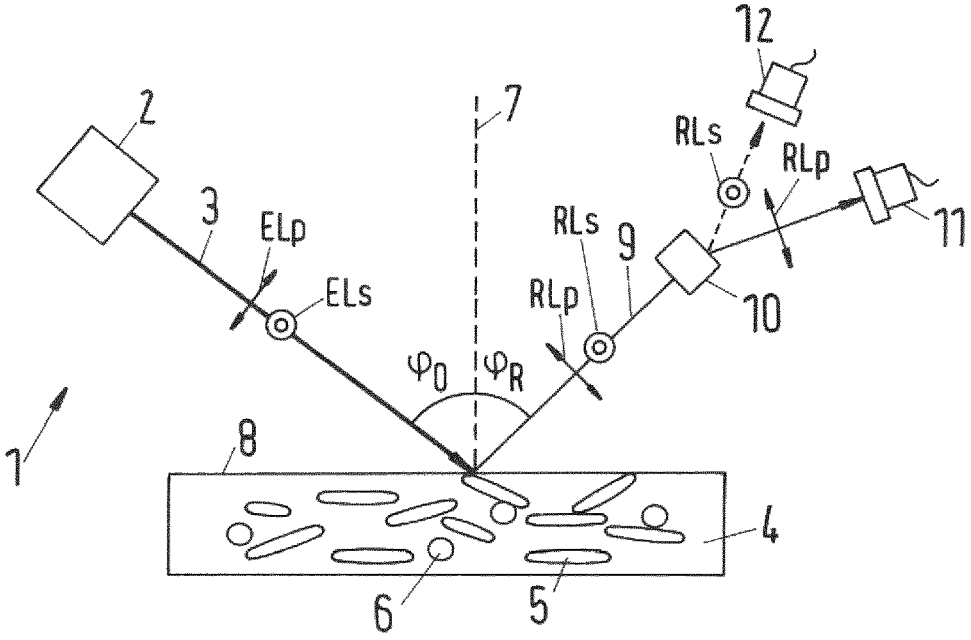

(58) Field of Classification Search
USPC ..... 356/71
See application file for complete search history.

(56) References Cited

U.S. PATENT DOCUMENTS

| | | | | |
|---|---|---|---|---|
| 2002/0191175 | A1 | 12/2002 | Coombs et al. | |
| 2003/0042438 | A1 | 3/2003 | Lawandy et al. | |
| 2008/0158545 | A1* | 7/2008 | Soramae ..... | G07D 7/12 356/71 |
| 2011/0095080 | A1 | 4/2011 | Beck et al. | |
| 2011/0250410 | A1 | 10/2011 | Rygas et al. | |
| 2011/0317150 | A1 | 12/2011 | Decoux et al. | |

FOREIGN PATENT DOCUMENTS

| | | | |
|---|---|---|---|
| EP | 1748903 | B1 | 2/2007 |
| EP | 1857985 | | 11/2007 |
| EP | 1867977 | A1 | 12/2007 |
| EP | 2228671 | A1 | 9/2010 |
| JP | 2007276444 | | 10/2007 |
| WO | WO2004013817 | A2 | 2/2004 |
| WO | 2010118897 | | 10/2010 |

* cited by examiner

METHOD AND DEVICE FOR TESTING A SECURITY ELEMENT OF A SECURITY DOCUMENT

BACKGROUND OF THE INVENTION

1. Field of the Invention

The invention is directed to a method and a device for testing a security element of a security document.

2. Brief Description of the Related Art

Value or security documents can contain one or a plurality of security elements, it being possible to ascertain, for example, the authenticity of the value or security document as a function of a verification of a security element. In order to be able to identify, say, counterfeits of such documents, it is desirable to create methods and devices for the reliable testing of such security elements.

It is known that value or security documents can contain so-called effect pigments. These effect pigments can configure a security element, or be part of a security element. EP 1 748 903 B1, for example, describes a machine-readable security element for security products. This publication describes optically variable platelet-shaped effect pigments which, from at least two different angles of illumination or observation, display at least two and at most 4 optically clearly distinguishable discrete colours. The security element can also contain at least one particle-like substance with electroluminescent properties.

DE 10 2007 063 415 A1 discloses a method and a corresponding device for recognising a product or information concerning the product. This method identifies a hidden coding carried by the product; the coding is given by a set of ellipsometric parameters and the method comprises the following steps:

- measuring ellipsometric variables for at least one defined point on a surface of the product,
- comparing the measured ellipsometric variables with at least one previously archived coding and
- finding a match between the measured ellipsometric variables and the archived coding or one of the archived codings, or finding a non-match with every archived coding.

U.S. Pat. No. 6,473,165 B1 discloses an automated verification system for authenticating an object with an optical security feature. The verification system comprises an optical system, a transport apparatus and an analyser. The optical system comprises one, or a plurality of, light sources for generating a narrow-band or broad-band light beam. The transport apparatus interacts with the light sources and is configured in such a way that the object is positioned so that one, or a plurality of, light beams strike a section in which the security feature is to be arranged. The analyser receives the light beams reflected by, or which pass through, the object and is adapted so that optical properties of the light beams can be analysed at different angles and/or wavelengths in order to verify the object's authenticity.

A verification can be effected as a function of the effects produced by the optically variable effect pigments. For example, a colour shift effect produced by the optically variable effect pigments is available for verification.

Nevertheless, verifying an effect produced by optically variable effect pigments, in particular the colour shift effect, can be difficult or impossible in certain fields of application. It is also possible for the effect produced by optically variable effect pigments such as the colour shift effect to be imitated with the help of other effect pigments. Thus the optical verification methods which work on the basis of the produced effect can verify one optically variable effect pigment even though another effect pigment is in fact present, resulting in a false verification.

The use of optically variable effect pigments as field displacement elements together with electroluminescent pigments is also known. Electroluminescent pigments facilitate a verification as a function of emitted electroluminescent radiation when such an electroluminescent pigment is excited, e.g. by an electrical field. Such an excitation and verification can also be difficult or even impossible in many application scenarios, such as bank ATMs. Here it can be desirable to perform a verification independently of electroluminescent radiation.

There is therefore the technical need of providing a method and a device for the reliable verification of a security element of a value or security document which both allow reliable testing and broaden the scope within which such testing can be used.

SUMMARY OF THE INVENTION

A fundamental idea of the invention is to illuminate a security element with predetermined illumination parameters and to determine an intensity of a component of the light reflected by the security element which (component) is polarised with a certain polarisation, in particular at different reflection angles. The presence of an effect pigment in the security element, and if necessary a certain type of effect pigment, can then be ascertained as a function of the intensity.

A method for testing a security element of a security document is proposed. The security element can be arranged or contained in, or on, the security document.

The security element can contain at least one substance with optically variable properties. The substance can in particular be a particulate, preferably in power form. A particulate substance can also comprise in particular platelet-shaped particles. The substance may also take the form of a pigment.

The security element, for example, can contain so-called field displacement elements which constitute the substance which has optically variable properties. Field displacement elements can be formed, for example, from dielectric material having a dielectric constant that is chosen to be suitably high. Through the field displacement elements, an externally imposed electrical field can be amplified in the region of intervals left by the field displacement elements as a result of the suitably high dielectric constant and due to the field displacement which this produces. This makes it possible to advantageously achieve—in the said intervals—the field strengths needed to excite the electroluminescence of the electroluminescent pigments; the field displacement elements can be suitably dimensioned, in particular with regard to the size of the intervals left between them for the desired amplification effect. An especially effective field compression in the intervals left by the field displacement elements can be achieved if the field displacement elements are formed from electrically conductive material so that they configure so-called 'floating' electrodes which are electrically isolated from their environment.

Field displacement elements can comprise a lateral size of up to approx. 500 μm, in particular a size of between 2 μm and 100 μm.

To ensure a manipulation and focusing of the electrical field which is selective and can be adapted to the electroluminescent pigments which are used, it is an advantage if the field displacement elements are applied to a supporting body of the security document typographically, so for example with the use of a common printing method such as rotogravure or screen printing.

In addition to the electroluminescent pigments, the field displacement elements or at least some of them in the form of having a dielectric constant of over approx. 50, preferably as electrically conductive pigments, can also be embedded in a marking layer which forms the security element.

The proposed method is however also suitable for checking a security element which has an optically variable substance that is not configured as a field displacement element or does not contain such field displacement elements. Nor is it absolutely necessary for the security element to contain an electroluminescent substance such as electroluminescent pigments.

The substance possessing optically variable properties may also be referred to as a so-called effect pigment or may contain such effect pigments. The substance possessing optically variable properties can leave behind a different visually perceivable impression of colour and/or brightness from different illumination and/or viewing angles. In the case of different colour impressions this property can be referred to as 'colour flop'. Substances in particular which comprise or produce a colour flop create—in the security elements which are manufactured with it—non-reproducible colour and brightness impressions which can be readily perceived by the naked eye unaided.

From at least two different illumination or viewing angles, the optically variable substance can comprise at least two and at most four optically clearly distinguishable discrete colours, but preferably two such colours from two different illumination or viewing angles or three from three different illumination or viewing angles. It is preferable if only the discrete hues are present and no intermediate stages, i.e. a clear change can be observed from one colour to another colour when the security element which contains the optically variable substance is tilted. On the one hand this property makes it easier for the viewer to recognise the security element as such while making it more difficult to copy the feature because standard commercial colour copiers cannot copy or reproduce colour flop effects.

In order to produce the full optical effect it is an advantage if the inventively deployed substance possessing the optically variable properties is present in the security element which contains them in oriented form, i.e. it can be aligned virtually parallel to those surfaces of the security document which are provided with the security element.

Platelet-shaped effect pigments in particular can be used as an optically variable substance. By way of example, the commercially available interference pigments marketed under the names of Iriodin®, Colorstream®, Xirallic®, Lustrepak®, Colorcrypt®, Colorcode® and Securalic® by Merck KGaA, Mearlin® marketed by Mearl, metal effect pigments marketed by Eckhard and goniochromatic (optically variable) effect pigments such as for example Variochrom® by BASF, Chromafflair® by Flex Products Inc., Helicone® by Wacker or holographic pigments marketed by Spectratec as well as other equivalent commercially available pigments can be used as platelet-shaped effect pigments. The above list should be regarded as being by way of example and not exhaustive.

Which hues are reflected by the optically variable substance at which angle of incidence with white light irradiation can, in particular, be known in advance.

Any document which is a physical entity that is protected from unauthorised production and/or counterfeiting by security features is referred to as a security document. Security features are features which make counterfeiting and/or duplicating at least difficult as compared with plain copying. Physical entities which contain or constitute a security feature may be referred to as security elements or they may contain security elements. A security document may contain a plurality of security features and/or security elements. In the sense of the definition determined here, a security document also always constitutes or contains a security element. Examples of security documents which also comprise value documents that represent a value include passports, identity cards, driving licences, access permits, health insurance cards, bank notes, postage stamps, bank cards, credit cards, smart cards, tickets and labels.

The proposed method comprises the method steps described below.

In a first step, the security element or a region of the security document in which the security element is disposed is illuminated with at least one predetermined illumination parameter. This can be effected with a light source for example.

Illumination parameters include for example an illumination angle. In this context, the illumination angle refers to an angle of incidence of the light. This angle of incidence can be defined in a plane of incidence of the light as the angle between an incident light and a normal vector of a surface of the security element or security document. A light beam of the incident light travels in the plane of incidence that is oriented orthogonally to the previously explained surface of the security element or security document.

An illumination parameter can also be a wavelength of the incident light. An illumination parameter can also be a polarisation state of the incident light. A polarisation state can be described for example as a function of a polarisation azimuth and/or of a polarisation-related ellipticity. An illumination parameter can in particular also be an intensity of the irradiated light.

It is of course conceivable for other illumination parameters of the incident light to be selected as predetermined illumination parameters.

In particular, the at least one illumination parameter can be an illumination parameter which a user can adjust.

In a second method step, the light reflected by the security element is filtered into a first component having a first polarisation. The first component of the reflected light having a first polarisation is referred to hereinafter as the 'first component' for short. In particular, light reflected by the security element or security document at a predetermined reflection angle can be filtered. Out of the light reflected by the security element is therefore filtered a component or a component with a particular polarisation. A polarisation angle of the first component can be determined for example in relation to a reflection plane or emergent plane, with the reflection plane or emergent plane being oriented at right angles to the previously explained surface of the security element or security document and a light beam of the reflected light travelling in the reflection plane or emergent plane. The first component can comprise a polarisation angle of 90° for example. The polarisation angle can of course also assume values different from 90° however. This will be explained more fully below.

The filtering can be done using a means for polarisation filtering, in particular a so-called polarisation filter.

A third method step involves determining an intensity of the first component of reflected light that is reflected at a reflection angle. As an angle in a reflection plane of the light, the reflection angle can be defined here as the angle between the reflected light and the normal vector of a surface of the security element or security document. A light beam of the reflected light travels in the reflection plane that is oriented orthogonally to the previously explained surface of the security element or security document. Reflection plane can also be referred to as emergent plane. The intensity is determined for at least one but preferably for a plurality of different reflection angles.

A fourth method step involves verifying the presence of a substance which has optically variable properties as a function of the intensity of the first component. The intensity of the first component can be determined by a means for determining intensity, for example an optical sensor. It may also be possible to identify a kind or type of the substance which has optically variable properties as a function of the intensity of the first component. The kind or type of the substance is referred to hereinafter as 'type' for short. Thus a verification of the security element may also be effected as a function of the identified type. A type characterises a security element which consists of a predetermined material or a predetermined material composition. The verification may also be effected depending on the reflection angle which can be quantitatively measured or determined for this purpose.

The proposed method makes advantageous use of two effects which are produced by the optically variable substance. First, a polarisation state of the irradiated light is altered by the substance which has optically variable properties. This means that polarisation properties of the light reflected by the security element differ from polarisation properties of the irradiated light. This effect is similar to the known effect that at a material-specific Brewster angle, primarily one of a plurality of polarisation components of the irradiated light is reflected.

A second effect is obtained through the interference of the reflected light beams caused by the substance which has optically variable properties. This interference is a function of a geometrical variable, in particular a film thickness, of the substance or of constituent parts—in particular pigments—of the substance. The interference also depends on orientations of the constituent parts of the substance relative to an (idealised flat) surface of the security element or security document. Thus the interference is dependent on the inhomogeneity of the surface of the security element. Since irradiated light can at least partly penetrate through the substance which has optically variable properties, the interference is also dependent on films, for example paper films, which lie beneath this substance relative to the direction of irradiation. The relevant inhomogeneities of a surface of paper can for example be far greater than a thickness of interference films, and correspond for example to individual pigment particles or particle agglomerates.

The material composition of the security document and of the security element, as well as a distribution and orientation in or on the security document of elements, in particular pigments, of the substance which has optically variable properties therefore produces a scattering of the incident light.

When they interact, both effects cause there to be a polarised light scattering through the substance which has optically variable properties, and the polarised light scattering in turn comprises properties which make it possible to verify the presence and, as is explained more fully below, if applicable a type of the substance which has optically variable properties.

It is also possible that in addition to the two previously explained effects, scatter effects also produced for example by the inhomogeneity of the surface of the security element and films lying beneath the security element, contribute to the polarised light scattering.

In particular, the aforesaid effects can cause the light that is reflected by the security element and which possesses certain polarisation properties to display a predetermined intensity at a certain reflection angle.

The change in polarisation properties described above may be dependent in particular on the type of substance which has optically variable properties. The change in polarisation properties may also be dependent on the at least one illumination parameter.

The presence of a substance which has optically variable properties as a function of the intensity of the first component can for example be verified if the intensity matches a predetermined intensity or lies within a predetermined intensity interval. Its presence can for example be verified if the intensity of the first component is greater or less than a predetermined intensity, or lies about a predetermined intensity within a predetermined intensity interval.

The predetermined intensity can be ascertained for example in preliminary tests. One type or a plurality of types of substances which have optically variable properties can be illuminated in preliminary tests and/or by simulation. Different test parameters can be used for this purpose. Different illumination parameters can be selected for example. Alternatively or cumulatively, different reflection angles can be set. Again alternatively or cumulatively, an intensity of the first component can be determined for different polarisation states of the first component. A polarisation state can be described for example by a polarisation angle. Again alternatively or cumulatively, other selectable parameters which influence the level of intensity of the first component can of course also be selected.

The type of substance, the set test parameters and the intensity of the first component recorded as a function of the set test parameters can then be stored for example in a storage device, for example in the form of a database.

The inventively determined intensity of the first component can then be compared with stored intensities, and as a function of this comparison, the presence of at least one of a plurality of types of the substance with optically variable properties can be verified. As well as the presence being verified, the type can also be identified. For example, the type can be identified as a type belonging to a stored intensity if, when tested with certain test parameters, the inventively determined intensity of the first component does not deviate, or only deviates by a predetermined amount, from the stored intensity which has been measured under identical test parameters. The verification of the type can be successful for example when the inventively identified type matches a type to be expected for the tested document. Accordingly the verification of the type cannot be successful if the inventively identified type does not match the type to be expected for the tested document.

The proposed method advantageously facilitates a reliable verification of at least the presence of a substance which has optically variable properties. In particular, no excitation of electroluminescent pigments or an analysis of a colour shift effect is required for the verification of the security element.

The method comprises in particular the following steps:

In one method step an intensity of the first component of the reflected light is determined, said light being reflected at an angle of directed reflection. The angle of directed reflection is the same in terms of amount as the previously explained angle of incidence but it has a sign that is different in regard to a common angle convention.

In a further step an intensity of the first component of the reflected light is determined, said light being reflected at at least one other reflection angle which is different from the angle of directed reflection. The at least one other reflection angle is therefore selected to be different from the angle of directed reflection. In particular, in terms of value the at least one other reflection angle may be less or greater than the angle of directed reflection. The at least one other reflection angle can be the previously explained reflection angle.

The intensity of the first component can as previously explained be determined by a means for determining intensity, for example an optical sensor. It is possible for the first component to be filtered at different angles by the same means for polarisation filtering, and its intensity to be determined by the same means for measuring an intensity.

Alternatively it is possible for the first component when reflected at the angle of directed reflection to be filtered by a first means for polarisation filtering and for its intensity to be determined by a first means for measuring an intensity, and for the first component when reflected at the at least one further angle to be filtered by a further means for polarisation filtering and its intensity to be determined by a further means for measuring an intensity.

A comparison of the at least two determined intensities is carried out in a third step. A verification of the presence of a substance which has optically variable properties is effected if the intensity of the first component when reflected at the least one further reflection angle is greater than the intensity of the first component when reflected at the angle of directed reflection.

It is course possible to determine the intensity of the first component when reflected at a plurality of further reflection angles which are all different from the angle of directed reflection.

The presence of a substance which has optically variable properties cannot be verified if the intensity of the first component when reflected at the angle of directed reflection is greater than the intensity/intensities of the first component when reflected at the least one further reflection angle/the plurality of further reflection angles.

The presence of a substance which has optically variable properties can be verified if the intensity of the first component when reflected at at least one of these reflection angles which differ from the angle of directed reflection or at a plurality of such reflection angles is greater than the intensity of the first component when reflected at the angle of directed reflection.

The proposed method advantageously facilitates a reliable verification of at least the presence of a substance which has optically variable properties by an easily performed comparison of at least two intensities. This comparison uses the effect that with most materials or material compositions the intensity of the reflected light when reflected at the angle of directed reflection comprises an intensity maximum of the first component. It has been shown by experiment for example that materials used for example in a counterfeit as a substance which has optically variable properties comprise an intensity maximum of the first component when reflected at the angle of directed reflection.

In a further embodiment the at least one reflection angle, in particular the at least one further reflection angle, is selected as a characteristic scattering angle, this characteristic scattering angle being dependent on the at least one illumination parameter and on the type of a substance which has optically variable properties and which is to be verified.

This advantageously facilitates a reliable verification of the presence of a substance, in particular of a predetermined type of the substance, which has optically variable properties. This in turn advantageously facilitates an even more reliable verification of the security element.

In this embodiment use is made of the effect that a specific substance which has optically variable properties produces the previously explained polarised light scattering in such a way that a maximum of the intensity of the first component occurs at the substance-specific characteristic scattering angle.

If therefore the presence in the security element of a certain type of the substance which has optically variable properties is to be verified, then the at least one further reflection angle can be selected according to the substance-specific characteristic scattering angle. If the specific substance really is present in the security element then it is guaranteed with a great degree of certainty that the measured intensity of the first component when reflected at the characteristic scattering angle is greater than the measured intensity when reflected at the angle of directed reflection. However if the intensity of the first component measured at the characteristic scattering angle is less, then the presence of the specific substance in the security element can already be ruled out at this point in time.

In a preferred embodiment, a certain substance which has optically variable properties is identified if the intensity of the first component when reflected at the characteristic scattering angle is at its maximum and/or matches a predetermined intensity.

In a first alternative, it is possible to determine the intensity of the first component when reflected at a plurality of reflection angles, for example a plurality of reflection angles of a predetermined angle interval, and so to determine an intensity profile over a plurality of reflection angles. From this intensity profile it is possible to determine a reflection angle at which the intensity of the first component is at its maximum. The type of substance which has optically variable properties can then be identified as a function of this reflection angle of maximum intensity.

For example, the type can be identified as belonging to a stored characteristic scattering angle if the inventively determined reflection angle when tested with certain test parameters does not deviate or only deviates by a predetermined amount from this stored characteristic scattering angle which has been determined under identical test parameters. This can be carried out for example by way of a suitably configured evaluation device.

To this end and as previously explained, the respective substance-specific characteristic scattering angle can for example be stored in a database for different types of substances which have optically variable properties and if required for different test parameters as well. This information can be determined by preliminary tests for example.

Alternatively or cumulatively, the intensity of the first component of the light reflected at the characteristic scattering angle can be compared with predetermined intensity values. For example, the previously explained database can also contain alternatively or cumulatively for different types of substances, and if necessary for different test parameters, intensities of the first component which are determined at the characteristic scattering angle. This advantageously facilitates a rapid identification of a specific substance which has optically variable properties.

The intensity of the first component can be standardised to an intensity of the incident light for this purpose. This advantageously facilitates a reliable determining of the intensity even with different or fluctuating intensities of the incident light.

In a method for checking a security element of a security document therefore, the security element can be illuminated with at least one predetermined illumination parameter and a light reflected by the security element can be filtered in a first component with a first polarisation. It is now possible to determine an intensity of the first component when reflected at at least the previously explained characteristic scattering angle. A verification of a presence of and if necessary of a certain type of a specific substance which has optically variable properties can be carried out if the intensity of the first component matches a predetermined intensity. This advantageously facilitates a reliable intensity-based verification of a presence and an identification of a specific substance which has optically variable properties.

In a further embodiment, the light reflected by the security element is split into the first component and a further component having a polarisation orthogonal to the first polarisation, with the verification of the presence of a substance which has optically variable properties and/or an identification of a certain type of a substance which has optically variable properties being additionally effected as a function of an intensity of that further component.

The intensity of the further component can also be determined for this purpose. Specifically, this can be done for the light reflected at the angle of directed reflection and for the light reflected at reflection angles that are different from that angle of directed reflection.

In this respect, a presence of a substance which has optically variable properties can be verified as a function of a difference between the intensity of the first component and the intensity of the further component. The difference can be evaluated in the form of a differential or a ratio, for example. For example, a presence of a substance which has optically variable properties can be verified if the ratio is greater than a predetermined threshold.

This makes advantageous use of the effect that the reflected light is polarised in a predetermined way, in particular being polarised so that a distribution of the intensity among different polarisation states comprises a maximum and a minimum, with 90° polarisation angles lying between maximum and minimum.

Alternatively or cumulatively, a certain type of a substance which has optically variable properties can additionally be identified as a function of an intensity of the further component.

The intensity of the further component may be characteristic of a certain type of substance which has optically variable properties, for example.

The difference between the intensity of the first component and the intensity of the further component, and in particular the ratio of the intensity of the first component to the intensity of the further component, can also be characteristic of a certain type of substance.

It is thus advantageous when a certain type of substance which has optically variable properties can be identified more reliably. The characteristic intensity of the further component can also be stored in an appropriate database according to the explanations given above.

Consequently an illuminating of the security element with at least one predetermined illumination parameter can therefore be carried out in a method for testing a security element. The light reflected by the security element can then be filtered into a first component having a first polarisation and a further component which has a polarisation orthogonal to the first polarisation. An intensity of the first component and an intensity of the further component can then be determined. This can be done in particular for light which is reflected at the previously explained characteristic scattering angle.

The presence of a substance which has optically variable properties can be verified for example if the intensity of the first component and the intensity of the further component differ by more than a predetermined amount, for example the presence can be verified if a ratio of the intensity of the first component to the intensity of the further component is greater than a predetermined threshold.

Alternatively or cumulatively, a certain type of the substance which has optically variable properties can be identified as a function of the intensity of the first and of the further component. For example both the intensity of the first component and the intensity of the further component can be characteristic of a certain type of the substance. The difference between the intensity of the first component and the intensity of the further component, and in particular a ratio of the intensity of the first component to the intensity of the further component, can also be characteristic of the certain type of substance. This can be the case in particular for given test parameters, in particular for the previously explained characteristic scattering angle.

So for example preliminary tests and/or simulations can determine which intensities and/or which intensity ratio the first and the further component comprise when a certain type of the substance which has predetermined test parameters is tested. As previously explained, a verification can then be carried out as a function of these results.

In a further embodiment, an angle between a polarisation direction of the first component and a reflection plane can be selected as the characteristic polarisation angle, with the characteristic polarisation angle being at least dependent on the at least one illumination parameter and on the type of a substance which has optically variable properties and which is to be verified. Specifically, the angle between the polarisation direction of the first component and the reflection plane is selected such that an intensity of the first component compared with the intensities of the components with the remaining polarisation directions is maximum. The first component is therefore filtered in such a way that it comprises a maximum intensity on the basis of different polarisation directions. The corresponding polarisation angle is characteristic here of the type of substance which has optically variable properties and is dependent on the at least one illumination parameter.

Thus for example the angle between the polarisation direction of the first component and the reflection plane, and at which the first component comprises the maximum intensity, can be determined in preliminary tests and/or simulations for different illumination parameters and for different types of substances which have optically variable properties. The said angle can be stored, e.g. in the previously explained database, as a characteristic polarisation angle. The angle between the polarisation direction of the first component and the reflection plane can also be one of the previously explained test parameters.

In a subsequent test method, a means for polarisation filtering for example can then be arranged in such a way that the reflected light is filtered so that the polarisation direction of the first component and the reflection plane include the characteristic polarisation angle.

Because the characteristic polarisation angle is also substance-specific, the result is an advantageous increase in the reliability of the identification of a certain type of the substance which has optically variable properties.

In a further embodiment the security element is illuminated with linearly polarised light. This advantageously requires a measuring device which is less expansive than with elliptically polarised light.

As previously explained, as well as the substance which has optically variable properties the security element can contain an electroluminescent substance, in particular electroluminescent pigments. Specifically, the substance which has optically variable properties can contain or configure field displacement elements. In this case, and prior to the proposed method being carried out, the security element can be applied with an electrical alternating field in order to excite the electroluminescent pigments. An emitted luminescent light or an emitted tumescent radiation can then be measured. The inventive method can only be carried out here if emitted luminescent radiation is detected and/or if properties of the luminescent radiation match predetermined properties. Thus the inventive method can only be carried out if the electroluminescent substance has been successfully verified. Consequently the inventive test can only be performed if a presence (of a certain type) of an electroluminescent substance is detected. If the verification of the electroluminescent substance is not successful then the method can be cancelled, in which case the inventive method for testing is not carried out.

Alternatively the inventively proposed method for testing can be carried out first, in which case a further verification of the electroluminescent substance is not carried out until after the successful verification of the substance which has the optically variable properties. For this purpose the electrical alternating field can be applied to the security element to excite the electroluminescent pigments. The emitted luminescent light or the emitted luminescent radiation can then be detected. A verification of the electroluminescent substance can be carried out for example if emitted luminescent radiation is detected and/or if properties of the luminescent radiation match predetermined properties. If there is no successful verification of the substance which has the optically variable properties, then no verification of the electroluminescent substance is carried out.

A device for testing a security element of a security document is also proposed; the security element can contain at least one substance which has optically variable properties.

The device comprises at least one light source for illuminating the security element. This light source can be adjustable. Specifically, illumination parameters of the light source can be adjustable. Thus for example a wavelength, an intensity, an angle of incidence and/or a polarisation state of the light produced by the light source can be adjusted.

It is of course conceivable that as well as the light source the device comprises other optical elements such as for example optical filters, modulators and means for beam guiding, it being possible to use these optical elements to set illumination parameters of the light produced by the light source. Thus a polarisation state of the irradiated light can be set by a polarisation filter for example.

The device also comprises at least one means for the polarisation filtering of the light reflected by the security element. By way of the means for polarisation filtering it is possible to filter a first component of the reflected light with a first polarisation filter.

For this purpose the means for polarisation filtering can be configured and/or arranged, and in particular oriented, such that a polarisation direction of the first component matches the previously explained characteristic polarisation angle.

The device also comprises at least one first means for detecting an intensity of the first component.

The device also comprises at least one evaluation device configured for example as a microprocessor and which can be connected for data and/or signal transmission to the means for detecting an intensity.

An intensity of the first component of reflected light which is reflected at a reflection angle can be determined for at least one reflection angle by way of the first means for detecting an intensity. The presence of a substance which has optically variable properties as a function of the intensity of the first component can be verified by way of the evaluation device.

The device advantageously facilitates the performing of one of the previously explained methods.

In particular, an intensity of the first component of reflected light which is reflected at an angle of directed reflection can be determined by way of the first means for detecting an intensity. By way of the first means or of a further means for detecting an intensity it is possible to determine an intensity of the first component of reflected light which is reflected at at least one further reflection angle, this further reflection angle being different from the angle of directed reflection.

By way of the evaluation device it is then possible to verify the presence of a substance which has optically variable properties if the intensity of the first component when reflected at the least one further reflection angle is greater than the intensity of the first component when reflected at the angle of directed reflection.

The means for polarisation filtering as well as the first means for detecting an intensity can be configured and/or arranged so that the first component is filtered and its intensity detected only at the angle of directed reflection.

By way of the first means for detecting an intensity it is also possible to determine an intensity of the first component when reflected at at least one further reflection angle which is different from the angle of directed reflection. For this purpose, an arrangement, in particular a position and/or orientation, of the first means for detecting an intensity and if necessary also of the means for polarisation filtering can be variable in such a way that only light reflected at the at least one further reflection angle is filtered and detected. For this purpose the device can comprise a suitable adjustment apparatus for adjusting the arrangement, in particular the position and/or orientation, of the first means for detecting an intensity and/or of the means for polarisation filtering.

Alternatively, the intensity of the first component when reflected at the at least one further reflection angle can be determined by way of a further means for detecting an intensity. In this case the device can also comprise a further means for polarisation filtering. The further means for detecting an intensity and/or the further means for polarisation filtering can be configured and/or arranged so that the first component is only filtered from light which is reflected at the at least one further reflection angle, and its intensity determined. By way of the evaluation device the presence of a substance which has optically variable properties can be verifiable if the intensity of the first component when reflected at the least one further reflection angle is greater than the intensity of the first component when reflected at the angle of directed reflection.

The first means for detecting an intensity and/or the at least one further means for detecting an intensity can be installed at a spatially fixed position. This means that a position and/or orientation of the corresponding means for detecting an intensity is unchangeable.

The proposed device advantageously allows one of the previously explained methods to be performed.

In a further embodiment, at least one reception angle of the first means for detecting an intensity can be adjusted. This means that a relative position and/or relative orientation of the first means for detecting the security element can be changed. Thus for example a position and/or orientation of the first means for detecting an intensity and/or a position and/or orientation of the security element can be changed. In particular, the reception angle can be selected so that a desired reflection angle is set.

Alternatively or cumulatively the device comprises at least one further means for detecting an intensity of the first component, whereby a reception angle of the at least one further means for detecting an intensity can be set. This also means that a relative position and/or relative orientation of the further means for detecting an intensity of the security element can be changed.

It is of course also possible to change a position and/or orientation of the means for polarisation filtering and/or of the further means for polarisation filtering. A reception angle of this means for polarisation filtering can therefore also be selected.

This advantageously facilitates the detection of intensities of the first component for a plurality of reception angles and hence reflection angles. Consequently the proposed device can also be used to identify different types of substances which have optically variable properties and which also comprise different characteristic scattering angles.

In a further embodiment, a further component having a polarisation orthogonal to the first polarisation can additionally be filtered out of the light reflected by the security element by way of the at least one means for polarisation filtering. In this case the device can comprise a means for detecting an intensity of the further component.

The first and/or the at least one further means for polarisation filtering may also be configured as a polarisation beam splitter or as a polarisation filter, in particular as a polarisation film.

BRIEF DESCRIPTION OF THE DRAWING FIGURES

Figure 2:
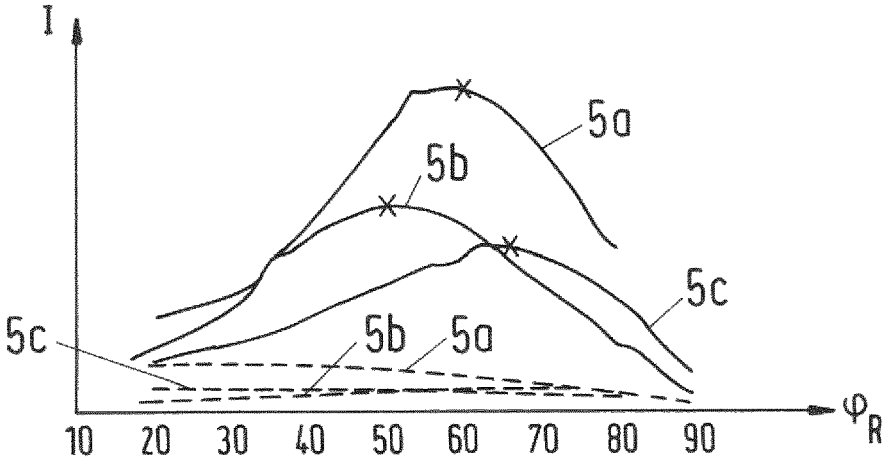
Figure 3:
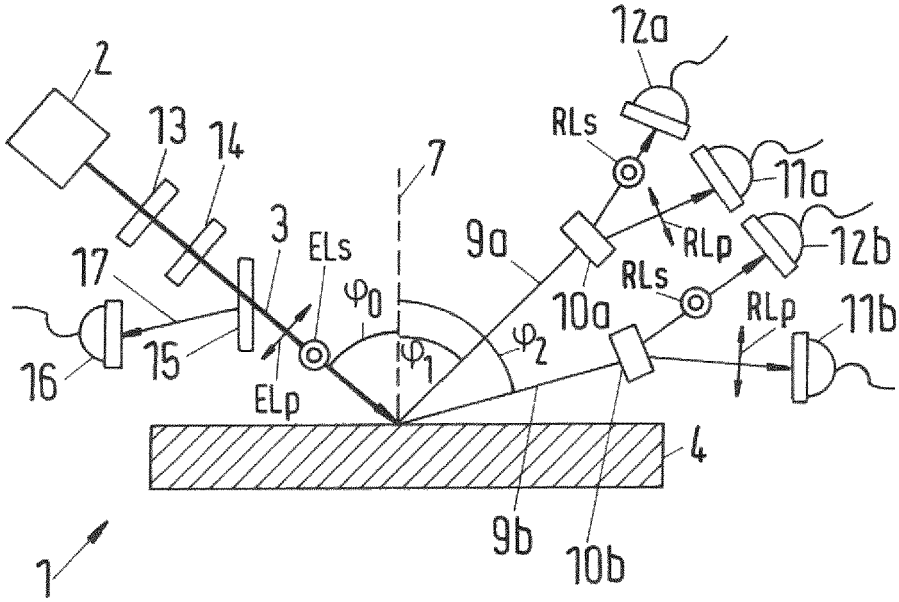
Figure 4:
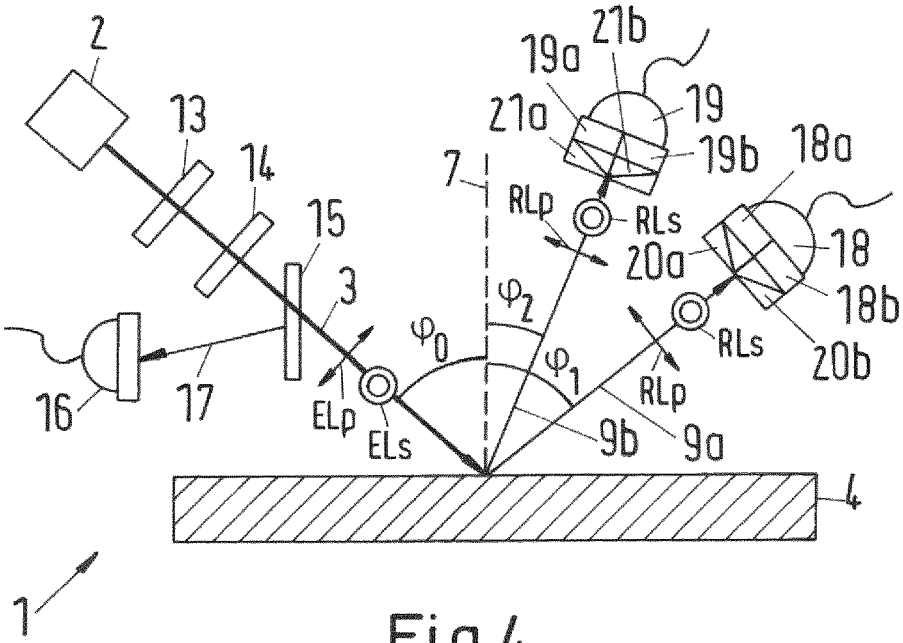
Figure 5:
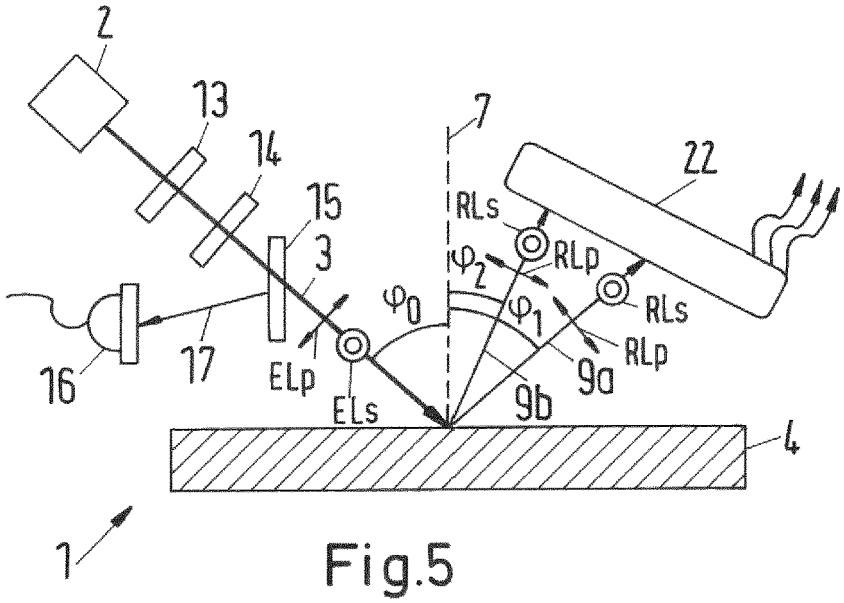
Figure 6:
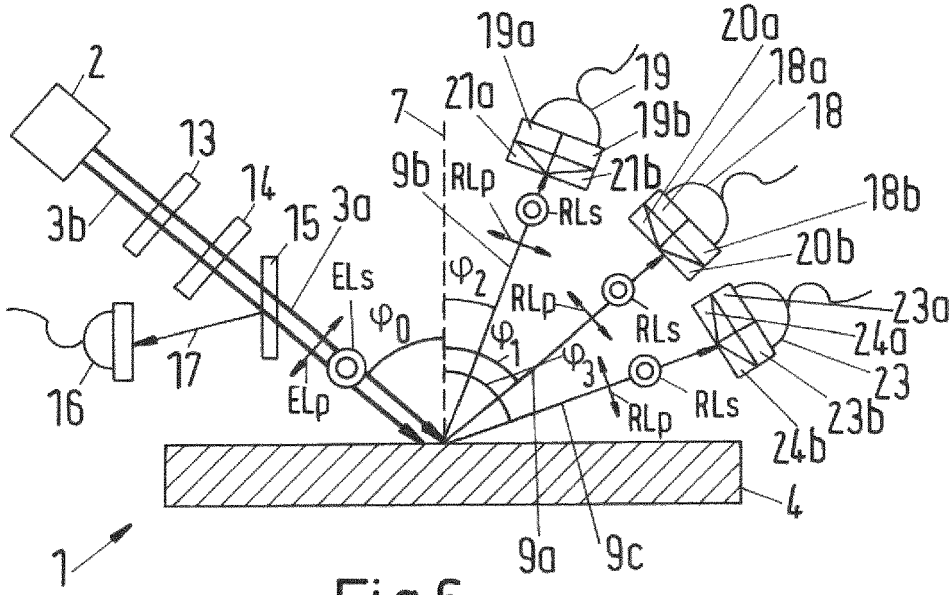
Figure 7:
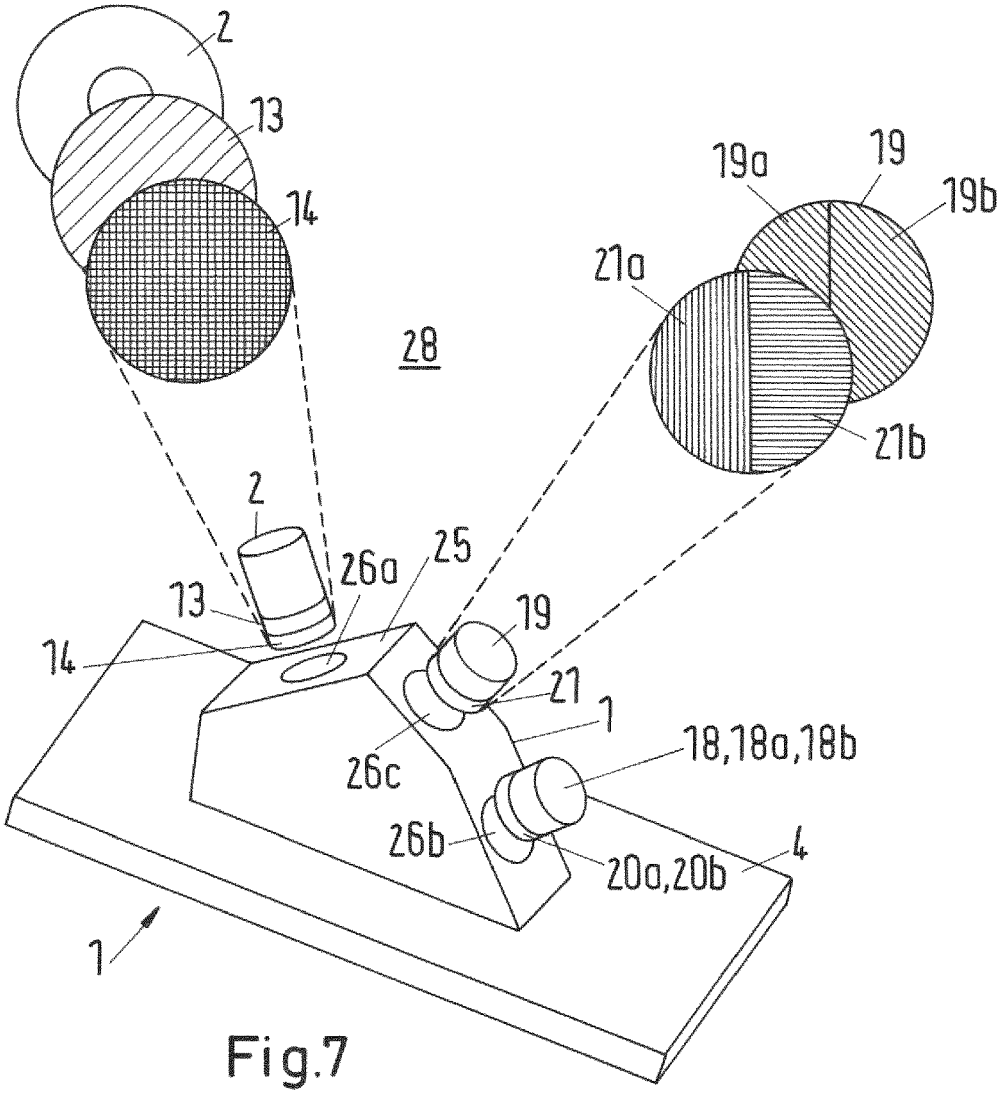
Figure 8:
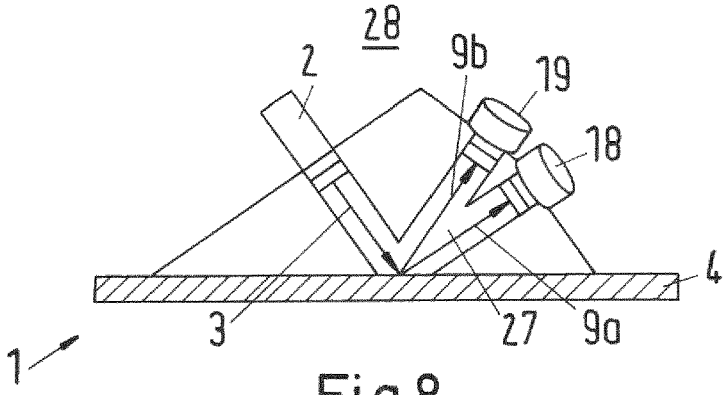
Figure 9:
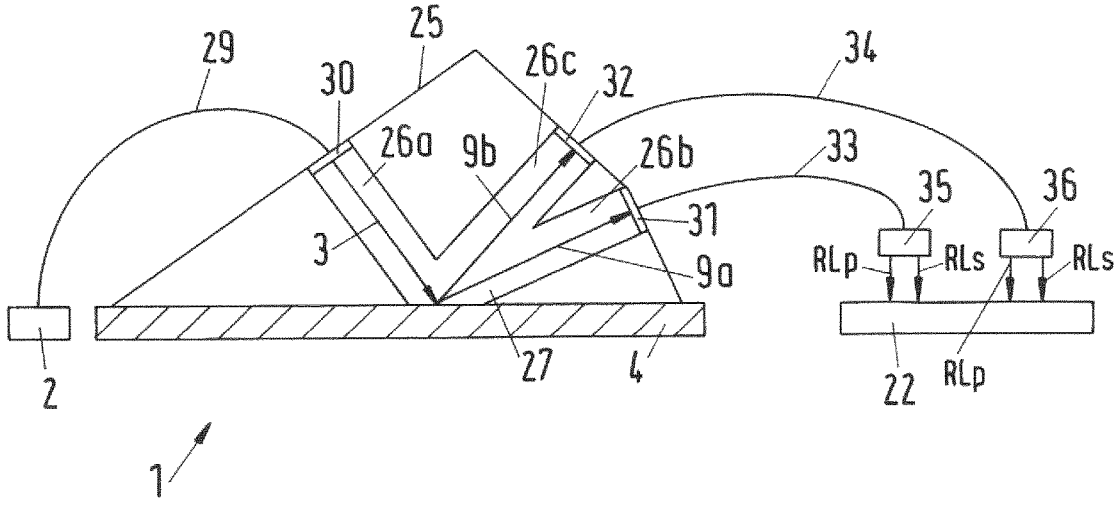

The invention is now explained more fully by reference to a plurality of embodiments. The figures show:

FIG. 1 a schematic representation of the method of operation of an inventive device in a first embodiment, FIG. 2 typical profiles of intensities of a first component and second component of different types of substances which have optically variable properties, FIG. 3 a schematic representation of an inventive device in a second embodiment, FIG. 4 a schematic representation of an inventive device in a third embodiment, FIG. 5 a schematic representation of an inventive device in a fourth embodiment, FIG. 6 a schematic representation of an inventive device in a fifth embodiment, FIG. 7 a perspective view of an inventive device and FIG. 8 a longitudinal section through the device shown in FIG. 7 and FIG. 9 a longitudinal section through a further inventive device.

DETAILED DESCRIPTION OF THE PREFERRED EMBODIMENTS

In the following sections the same reference signs indicate elements with the same or similar technical features.

An inventive device 1 in a first embodiment is shown schematically in FIG. 1. Device 1 comprises a light source 2. Light source 2 radiates light represented for example by a light beam 3, having an angle of incidence $\phi_0$ onto a security element 4 which can be part of a security document (not shown). Security element 4 contains a substance 5 which has optically variable properties and which in particular is configured as an effect pigment. Electroluminescent pigments 6 are arranged In intervals between particles or elements of substance 5. Substance 5 acts as a field displacement element for field concentration in order to excite the electroluminescence of electroluminescent pigments 6.

FIG. 1 shows that angle of incidence $\phi_0$ is defined as an angle between a normal direction 7 oriented at right angles to a surface 8 of security element 4 or of the security document (not shown), and light beam 3. Light beam 3 shown in FIG. 1 travels in a plane of incidence (not shown) which is also oriented at right angles to surface 8 and in which are disposed straight lines running parallel to normal direction 7. The figure shows that light beam 3 has a first component ELp which comprises a polarisation plane running in the plane of incidence. Light beam 3 also has a further component ELs whose polarisation plane is oriented at right angles to the plane of incidence. ELp and ELs may be any desired orthogonal polarisation states however.

Light beam 3 comprises a predetermined wavelength and a predetermined polarisation state.

Device 1 also comprises a polarisation beam splitter 10, a first light sensor 11 and a second light sensor 12. Polarisation beam splitter 10 and light sensors 11,12 are disposed in such a way that light which is reflected at a predetermined reflection angle $\phi_R$ and which by way of example is represented by a reflected light beam 9, is filtered and received.

Reflection angle $\phi_R$ is defined as the angle between normal direction 7 which is oriented at right angles to surface 8 of security element 4 or of the security document (not shown), and reflected light beam 9, with reflected light beam 9 travelling in a reflection plane which is also oriented at right angles to surface 8 of security element 4 or of the security document (not shown) and in which straight lines running parallel to normal direction 7 are arranged.

The reflected light contains a first component RLp having a polarisation direction which runs in the reflection plane. The reflected light also contains a further component RLs having a polarisation direction at right angles to the polarisation direction of first component RLp. The first component RLp as well as the further component RLs are filtered out of reflected light beam 9 by polarisation beam splitter 10, with an intensity I (see FIG. 2) of the first component RLp being determined by first light sensor 11 and an intensity I of the further component RLs being determined by second light sensor 12.

Intensities I can also be determined for a plurality of reflection angles $\phi_R$. For this purpose a position and orientation of polarisation beam splitter 10 and of light sensors 11,12 can be changed so that a predetermined number of different reflection angles $\phi_R$ are set. The intensities I of the first component RLp and of the further component RLs can then be determined for each of these reflection angles $\phi_R$.

For example, intensities for a predetermined number of, say, equidistant reflection angles $\phi_R$ can be detected in an angle interval of 0° to 90°.

It may also be possible to determine a maximum intensity I of the first component RLp and the corresponding reflection angle $\phi_R$. This corresponding reflection angle $\phi_R$ can also be referred to as the characteristic scattering angle $\phi_2$ (see FIG. 3) which is substance-specific. The characteristic scattering angle $\phi_2$ can also be dependent on a wavelength of the irradiated light. The characteristic scattering angle $\phi_2$ can also be a function of properties of security element 4, in particular of a surface orientation and/or roughness of security element 4. It can therefore be possible to determine the presence and type of substance 5 or of security element 4 as a function of the characteristic scattering angle $\phi_2$.

The presence of a substance 5 can be verified for example by setting a position and an orientation of polarisation beam splitter 10 and of light sensors 11,12 such that the reflected light is reflected at an angle $\phi_1$ (see FIG. 3) of directed reflection and its intensity I is detected. The angle of directed reflection has the same value as the angle of incidence $\phi_0$ but is oriented counter to the angle of incidence $\phi_0$ in regard to normal direction 7.

The position and orientation of polarisation beam splitter 10 and of light sensors 11,12 may also be selected such that the reflected light is reflected at a further reflection angle $\phi_R$ which differs from the angle $\phi_1$ of directed reflection. Here again, intensities I of the different polarised components RLp, RLs of the reflected light can be detected. The presence of substance 5 can be verified in this case if intensity I of the first component RLp of the reflected light that is reflected at the angle $\phi_1$ of directed reflection is less than the intensity of the first component RLp of reflected light that is reflected at the further reflection angle $\phi_R$.

It is also possible to determine a presence and if applicable a type of substance 5 as a function of a difference, e.g. as a function of a differential or ratio, of intensity I of the first component RLp and intensity I of the further component RLs at one or a plurality of reflection angles $\phi_R$. Thus for example the difference between the intensities I of the components RLp, RLs at a predetermined reflection angle $\phi_R$, in particular the previously explained characteristic scattering angle $\phi_2$, or the curve of the difference over a plurality of different reflection angles $\phi_R$, can be characteristic of the type of substance 5, i.e. substance-specific. Thus for example a certain type of substance 5 can be identified if the difference between the intensities I of components RLp, RLs matches a difference determined for example by preliminary tests, or a curve of the difference over a plurality of reflection angles $\phi_R$ matches a predetermined curve or deviates from it by only a predetermined minimal amount.

A position and orientation of polarisation beam splitter 10 and of light sensors 11, 12, can of course be adjusted, in particular several times, until the difference, for example differential or ratio, between the intensity I of the first component RLp and of the further component RLs is maximum. The corresponding reflection angle $\phi_R$ and/or the corresponding polarisation angle of the first component which can be adjusted by altering the orientation of polarisation beam splitter 10 can be substance-specific, i.e. characteristic of a certain type of substance 5. Thus the presence of and a type of a certain substance 5 can be determined depending on the corresponding scattering angle $\phi_R$ and/or corresponding polarisation angle of the first component RLp.

For all of the previously explained test methods, it may be necessary for intensities I and/or differences between intensities I to be determined, e.g. in preliminary tests, for every type of substance 5 and for different test parameters, for example illumination parameters, reflection angles $\phi_R$ and/or polarisation angles. These relationships can then be stored for example in a storage device, e.g. in the form of a database. This will then facilitate the proposed verification as a function of the stored type, test parameters and values.

FIG. 2 shows an example of an intensity profile of an intensity I of the first component RLp and of the further component RLs (see FIG. 1) for three different types of substances 5*a*, 5*b*, 5*c* for different reflection angles $\phi_R$. It can be seen that the intensity profiles of intensity I of the first component RLp each comprise a global maximum in an angular range of 10° to 90°. For a first substance 5*a*, the maximum occurs at a reflection angle $\phi_R$ of 60°. For a second substance 5*b* the maximum occurs at a reflection angle $\phi_R$ of 50°. With a third substance 5*c* the maximum occurs at a reflection angle $\phi_R$ of 65°. The aforesaid angles of maximum intensity I correspond to characteristic scattering angles $\phi_2$ (see FIG. 3) of the different substances 5*a*, 5*b*, 5*c* and so are substance-specific.

Broken lines show intensity profiles of the further component RLs (see FIG. 1) of the different substances 5*a*, 5*b*, 5*c* over different reflection angles $\phi_R$. These are roughly constant for different reflection angles $\phi_R$ and indicate no global maximum or only one that is difficult to identify. However it can be seen that a difference between the intensities I of the first components RLp and the intensities I of the further components RLs of substances 5*a*, 5*b*, 5*c* is also maximum for the corresponding characteristic scattering angle $\phi_2$.

FIG. 3 is a schematic representation of a further embodiment of a proposed device 1. This is the same as device 1 shown in FIG. 1 except where stated.

As well as device 1 shown in FIG. 1, device 1 shown in FIG. 3 comprises a polarisation filter 13 with which a desired polarisation state of the incident light beam 3 is set. The device also comprises a waveplate 14 which can be configured as a $\lambda/4$ plate for example. Device 1 also comprises a beam splitter 15 which filters out a predetermined component 17 of incident light beam 3 from incident light beam 3. Predetermined component 17 may be 5% for example. Predetermined component 17 is detected, and its intensity determined, by a light sensor 16 which can be configured as a photo diode for example. This makes it possible to normalise intensities I (see FIG. 2) of the different components RLp, RLs of reflected light beams 9*a*, 9*b* to an intensity of incident light beam 3. A verification can now be carried out independently of different intensities, and in particular independently of intensity variations of the incident light beam.

Incident light beam 3 comprises a predetermined wavelength, a predetermined polarisation state and a predetermined angle of incidence $\phi_0$.

Device 1 also comprises a first polarisation beam splitter 10*a* and a further polarisation beam splitter 10*b*. It also comprises a first light sensor 11*a*, a second light sensor 12*a*, a third light sensor 11*b* and a fourth light sensor 12*b*.

First polarisation beam splitter 10*a* and first and second light sensor 11*a*, 12*a* are arranged and configured in device 1 such that a first reflected light beam 9*a* which is reflected by security element 4 at an angle $\phi_1$ of directed reflection, is filtered and the intensities of a first component RLp and of a further component RLs of this first reflected light beam 9*a* are detected. First polarisation beam splitter 10*a* is configured according to polarisation beam splitter 10 shown in FIG. 1. In particular, first light sensor 11*a* detects the intensity of the first component RLp of first reflected light beam 9*a* and second light sensor 12*a* detects the intensity I of the further component RLs of first reflected light beam 9*a*.

Further polarisation beam splitter 10*b*, third light sensor 11*b* and fourth light sensor 12*b* are arranged and configured in device 1 such that a further reflected light beam 9*b* that is reflected at a characteristic scattering angle $\phi_2$ of a substance 5 that is to be verified (see FIG. 1), is filtered and the intensities I of the first component RLp and of the further component RLs are detected. The intensity of the first component RLp of further reflected light beam 9*b* is detected by third light sensor 11*b* and intensity I of the further component RLs of the further reflected light beam 9*b* is detected by fourth light sensor 12*b*.

Device 1 shown in FIG. 3 is used in particular to verify a certain type of substance 5 (see FIG. 1). Accordingly the reflection angle $\phi_R$ (see FIG. 1) of further reflected light beam 9*b* corresponds to the characteristic scattering angle $\phi_2$ that is specific to the type of substance 5 that is to be verified.

FIG. 4 shows an inventive device 1 in a further embodiment. Unlike device 1 shown in FIG. 3, device 1 shown in FIG. 4 comprises a first segmented light sensor 18 and a further segmented light sensor 19. First segmented light sensor 18 comprises a first detection segment 18*a* and a further detection segment 18*b*. Similarly, further segmented light sensor 19 comprises a first detection segment 19*a* and a further detection segment 19*b*. Different polarisation filters 20*a*, 20*b*, 21*a*, 21*b* are arranged in the beam direction of reflected light beams 9*a*, 9*b* in front of detection segments 18*a*, . . . , 19*b* in such a way that first segment 18*a* of first segmented light sensor 18 detects an intensity I of a first component RLp of a first reflected light beam 9*a*, with said first reflected light beam 9*a* being reflected at the angle $\phi_1$ of directed reflection. Thus first polarisation filter 20*a* filters first component RLp out of first reflected light beam 9*a*. Similarly, further polarisation filter 20*b* filters a further component RLs out of first reflected light beam 9*a* whose intensity I is detected by further detection segment 18*b* of first segmented light sensor 18. A first component RLp of further reflected light beam 9*b* is filtered by a further polarisation filter 21*a*, with intensity I of this first component RLp being detected by first detection segment 19*a* of further segmented light sensor 19. Accordingly, intensity I of a further component RLs of further reflected light beam 9*b* is detected by further detection segment 19*b* of further segmented light sensor 19, with the further component RLs being filtered out of further reflected light beam 9*b* by further polarisation filter 21*b*. Here, further reflected light beam 9*b* is reflected at a scattering angle $\phi_2$ that is characteristic of a certain type of substance 5 (see FIG. 1) of security element 4.

FIG. 5 shows an inventive device 1 in a further embodiment. Unlike the embodiments shown in FIG. 3 and FIG. 4, instead of light sensors 11*a*, 11*b*, 12*a*, 12*b*, 18, 19, device 1 comprises a planar light sensor array 22 which is configured as a CCD sensor and comprises a plurality of light sensors. The figure does not shown polarisation filters which are arranged in the beam direction of reflected light beams 9*a*, 9*b* in front of light sensor array 22 in such a way that individual light sensors of light sensor array 22 detect intensities 1 of different components RLp, RLs of reflected light beams 9*a*, 9*b*.

In this embodiment, a reflection angle $\phi_R$ of reflected light beam 9*a*, 9*b* whose respective intensity I is being determined can be determined as a function of a position of the corresponding light sensors in light sensor array 22.

In FIG. 5, light sensors (not shown) of light sensor array 22 detect intensities I of components RLp, RLs of a first reflected light beam 9*a* which is reflected by security element 4 at angle $\phi_1$ of directed reflection. Similarly, further light sensors detect intensities I of components RLp, RLs of a further reflected light beam 9*b* which is reflected by security element 4 at a characteristic scattering angle $\phi_2$, with the characteristic scattering angle $\phi_2$ being substance-specific for a certain type of a substance 5 (see FIG. 1).

A further embodiment of an inventive device 1 is shown in FIG. 6. Unlike the embodiment of inventive device 1 shown in FIG. 4, device 1 shown in FIG. 6 comprises a third segmented light sensor 23. This segmented light sensor 23 has a first detection segment 23*a* and a further detection segment 23*b*. Polarisation filters 24*a*, 24*b* are arranged in the beam direction of a third reflected light beam 9*c* in front of detection segments 23*a*, 23*b* in such a way that first detection segment 23*a* can detect an intensity I of a first component RLp and further detection segment 23*b* can detect an intensity I of a further component RLs of third reflected beam 9*c*.

Third segmented light sensor 23 can be used to detect intensities I of components RLp, RLs of a light beam 9*c* reflected at a further angle $\phi_3$, as a result of which the reliability of the verification can be increased.

FIG. 6 also shows that light source 2 irradiates onto security element 4 a first light beam 3*a* having a first wavelength and a second light beam 3*b* having a wavelength that differs from the first wavelength. Since a characteristic scattering angle $\phi_2$ can be wavelength-dependent, the reflection angle $\phi_2$ shown in FIG. 6 for example can represent the substance-specific characteristic scattering angle in the event of an irradiation of light having the first wavelength, with the further reflection angle $\phi_3$ representing a substance-specific characteristic scattering angle in the event of an irradiation of light having the further wavelength.

Thus device 1 shown in FIG. 6 facilitates the illumination of the security element with two different wavelengths, making it possible to detect intensities I of components RLp, RLs of reflected light beams 9*b*, 9*c* which when illuminated with the corresponding wavelength each represent characteristic scattering angles. This advantageously facilitates a further increase in the reliability of a test of security element 4.

Alternatively, light source 2 can irradiate onto security element 4 a first light beam 3*a* having a first polarisation and a second light beam 3*b* having a polarisation that differs from the first polarisation. This advantageously facilitates a further increase in the reliability of a test of security element 4. Alternatively, the polarisation states of incident light beam 3 can be modulated or altered in sequence. In this case the evaluation of the measured data, i.e. the evaluation of intensities I of the components of reflected light beam/light beams 9*a*, 9*b*, 9*c*, can be synchronised with the change in the polarisation state of incident light beam 3.

A perspective view of an inventive device 1 is shown in FIG. 7. Device 1 comprises a housing 25 in which through-holes 26*a*, 26*b*, 26*c* are arranged. Housing 25 is disposed above security element 4 and comprises an inner volume 27 (see FIG. 8) which is open to security element 4. Through-holes 26*a*, 26*b*, 26*c* connect inner volume 27 to outer volume 28.

A light source 2 which emits light beam 3 shown for example in FIG. 1 is arranged in a first through-hole 26*a*.

Polarisation filter 13, which is shown for example in FIG. 4, and a waveplate 14 are arranged in front of light source 2 looking in the direction of irradiation. A first segmented light sensor 18 is arranged in a second through-hole 26*b*. As already described in the explanations relating to FIG. 4, first segmented light sensor 18 comprises a first detection segment 18*a* and a further detection segment 18*b* which are configured independently of one another as regards signalling. Polarisation filters 20*a*, 20*b* which facilitate the detection, as described in relation to FIG. 4, of intensities I of different components RLp, are arranged in front of detection segments 18*a*, 18*b* looking in the beam direction of a first reflected light beam 9*a* (see FIG. 4).

A further segmented light sensor 19 which is configured according to the explanations given in regard to FIG. 4 is arranged in a third through-hole 26*c*.

Through-holes 26*a*, 26*b*, 26*c*, in particular central axes of symmetry of through-holes 26*a*, 26*b*, 26*c*, are arranged in housing 1 in such a way that first segmented light sensor 18 receives a first reflected light beam 9*a* that is reflected by security element 4 at the angle $\phi_1$ of directed reflection. Accordingly, further segmented light sensor 19 arranged in third through-hole 26*c* receives a further reflected light beam 9*b* which is reflected by security element 4 at the characteristic scattering angle $\phi_2$.

First through-hole 26*a* is arranged and aligned such that light which has a predetermined angle of incidence $\phi_0$ is irradiated onto security element 4.

FIG. 8 shows a longitudinal section through device 1 shown in FIG. 7. It shows in particular inner volume 27 through which both irradiated light 3 and reflected light 9*a*, 9*b* pass.

FIG. 9 shows a longitudinal section through a further inventive device 1. It shows in particular inner volume 27 through which both irradiated light 3 and reflected light 9*a*, 9*b* pass. Unlike device 1 shown in FIG. 8, a light source 2 is connected by a polarisation-maintaining light guide 29 to a light outcoupling device 30 arranged in or on first through-hole 26*a*; in order to produce light beam 3, the light is guided via light guide 29 to light outcoupling device 30 and from there it is coupled out to light guide 29 as light beam 3.

Light beams 9*a*, 9*b* reflected by through-holes 26*b*, 26*c* are coupled into further polarisation-maintaining light guides 33, 34 by light incoupling devices 31, 32, which are each arranged in or on said through-holes 26*b*, 26*c*. The reflected light is guided by further light guides 33, 34 to a light sensor array 22 and coupled out of further light guides 33, 34 by further light outcoupling devices 35, 36. The figure shows that different components RLp, RLs of reflected light beams 9*a*, 9*b* are coupled out by light outcoupling devices 35, 36 and irradiated onto light sensors (not shown) of light sensor array 22. These then detect intensities I of components RLp, RLs of reflected light beams 9*a*, 9*b*.

It is therefore possible that light for illuminating security element 4 is at least partially guided via a light guide 29 from a light source 2 to security element 4. Alternatively or cumulatively, light reflected by the security element can be at least partially guided via a further light guide 33, 34 from security element 4 to a light sensor.

Depicted device 1 advantageously allows light source 2 and the light sensors to be freely positioned relative to a housing 25 or relative to security element 4, thereby improving the versatility of device 1.

It is possible for polarisation beam splitting and/or polarisation filtering to be effected by light guides 29, 33, 34 and/or light incoupling devices 32, 33 and/or light outcoupling devices 30, 35, 36.

Light guides 29, 33, 34 can be executed as light fibres or glass fibres for example.

LIST OF REFERENCE CHARACTERS

1 Device
2 Light source
3 Irradiated light beam
4 Security element
5 Substance
5*a* First substance
5*b* Second substance
5*c* Third substance
6 Electroluminescent pigment
7 Normal direction
8 Surface
9 Reflected light beam
9*a* First reflected light beam
9*b* Second reflected light beam
9*c* Third reflected light beam
10 Polarisation beam splitter
10*a* First polarisation splitter
10*b* Other polarisation splitter
11 First light sensor
12 Second light sensor
11*a* First light sensor
12*a* Second light sensor
11*b* Third light sensor
12*b* Fourth light sensor
13 Polarisation filter
14 Waveplate
15 Beam splitter
16 Light sensor
17 Component of irradiated light
18 First segmented light sensor
18*a* First detection segment
18*b* Further detection segment
19 Second segmented light sensor
19*a* First detection segment
19*b* Further detection segment
20*a* Polarisation filter
20*b* Polarisation filter
21*a* Polarisation filter
21*b* Polarisation filter
22 Light sensor array
23 Third segmented light sensor
23*a* First detection segment
23*b* Further detection segment
24*a* Polarisation filter
24*b* Polarisation filter
25 Housing
26*a* First through-hole
26*b* Second through-hole
26*c* Third through-hole
27 Inner volume
28 Outer volume
29 Light guide
30 Light outcoupling device
31 Light incoupling device
32 Light incoupling device
33 Further light guide
34 Further light guide
35 Further light outcoupling device
36 Further light outcoupling device
I intensity
$\phi_R$ Reflection angle
$\phi_0$ Angle of incidence
$\phi_1$ Angle of directed reflection
$\phi_2$ Characteristic scattering angle
$\phi_3$ Characteristic scattering angle
ELp First component of irradiated light
ELs Further component of irradiated light
RLp First component of reflected light
RLs Further component of reflected light

The invention claimed is:

1. A method for testing a security element (4) of a security document, the security element (4) being able to contain at least one substance (5) which has optically variable properties, comprising the following method steps:

illuminating the security element (4) with at least one predetermined illumination parameter, filtering the light reflected by the security element into a first component (RLp) having a first polarisation, determining an intensity (I) of the first component (RLp) of reflected light which is reflected at a reflection angle ($\phi_R$), for at least one reflection angle ($\phi_R$), whereby an intensity (I) of the first component (RLp) of reflected light which is reflected at an angle ($\phi_1$) of directed reflection is determined, whereby an intensity (I) of the first component (RLp) of reflected light which is reflected at least one further reflection angle ($\phi_R$) is determined, whereby the at least one further reflection angle ($\phi_R$) being different from the angle ($\phi_1$) of directed reflection, verifying the presence of a substance (5) which has optically variable properties as a function of the intensity (I) of the first component (RLp), the presence of the substance (5) which has optically variable properties being verified if the intensity (I) of the first component (RLp) when reflected at the at least one further reflection angle ($\phi_R$) is greater than the intensity (I) of the first component (RLp) when reflected at the angle ($\phi_1$) of directed reflection.

2. The method of claim 1 wherein the at least one reflection angle ($\phi_R$) is selected as a characteristic scattering angle ($\phi_2$,$\phi_3$), with the characteristic scattering angle ($\phi_2$,$\phi_3$) being dependent on the at least one illumination parameter and on the type of a substance (5) to be verified which has optically variable properties.

3. The method of claim 2 wherein a certain type of the substance (5) which has optically variable properties is identified if the intensity (I) of the first component (RLp) when reflected at the characteristic scattering angle ($\phi_2$,$\phi_3$) is maximum and/or matches a predetermined intensity (I).

4. The method of claim 3, wherein the light reflected by the security element (4) is split into the first component (RLp) and a further component (RLs) with a polarisation at right angles to the first polarisation, with the verification of the presence of a substance (5) which has optically variable properties and/or an identification of certain type of a substance (5) which has optically variable properties being also effected as a function of an intensity (I) of the further component (RLs).

5. The method of claim 4 wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties; and wherein the security element (4) is illuminated with linearly polarised light.

6. The method of claim 4, wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties.

7. The method of claim 3, wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties.

8. The method of claim 3, wherein the security element (4) is illuminated with linearly polarised light.

9. The method of claim 2, wherein the light reflected by the security element (4) is split into the first component (RLp) and a further component (RLs) with a polarisation at right angles to the first polarisation, with the verification of the presence of a substance (5) which has optically variable properties and/or an identification of certain type of a substance (5) which has optically variable properties being also effected as a function of an intensity (I) of the further component (RLs).

10. The method of claim 9, wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties.

11. The method of claim 2, wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties.

12. The method of claim 2, wherein the security element (4) is illuminated with linearly polarised light.

13. The method of claim 1, wherein the light reflected by the security element (4) is split into the first component (RLp) and a further component (RLs) with a polarisation at right angles to the first polarisation, with the verification of the presence of a substance (5) which has optically variable properties and/or an identification of certain type of a substance (5) which has optically variable properties being also effected as a function of an intensity (I) of the further component (RLs).

14. The method of claim 13, wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties.

15. The method of claim 13 wherein the security element (4) is illuminated with linearly polarised light.

16. The method of claim 1, wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties.

17. The method of claim 16, wherein the security element (4) is illuminated with linearly polarised light.

18. The method of claim 1, wherein the security element (4) is illuminated with linearly polarised light.

19. A device for testing a security element (4) of a security document, the security element (4) being able to contain at least one substance (5) which has optically variable properties, with the device (1) comprising at least one light source (2) for illuminating the security element (4), wherein the device (1) comprises at least one means for the polarisation filtering of the light reflected by the security element (4), and by way of the means for polarisation filtering a first component (RLp) of the reflected light can be filtered with a first polarisation, with the device (1) comprising at least one first means for detecting an intensity (I) of the first component (RLp), with the device (1) comprising at least one evaluation device, and by way of the first means for detecting an intensity (I) of the first component (RLp) of reflected light reflected at a reflection angle ($\phi_R$) can be determined for at least one reflection angle ($\phi_R$), and by way of the first means for detecting an intensity of the first component (RLp) of reflected light can be determined which is reflected at an angle ($\phi_1$) of directed reflection, and by way of the first means or of a further means for detecting an intensity (I) of the first component (RLp) of reflected light can be determined which is reflected at least one further reflection angle ($\phi_R$), whereby the further reflection angle ($\phi_R$) being different from the angle ($\phi_1$) of directed reflection, and by way of the evaluation device a presence of a substance (5) which has optically variable properties can be verified as a function of the intensity (I) of the first component (RLp), with the evaluation device being able to verify the presence of the substance (5) which has optically variable properties if the intensity (I) of the first component (RLp) when reflected at the at least one further reflection angle ($\phi_R$) is greater than the intensity (I) of the first component (RLp) when reflected at the angle ($\phi_1$) of directed reflection.

20. The device of claim 19 wherein a reception angle of the first means for detecting an intensity (I) is adjustable and/or the device (1) comprises at least one further means for detecting an intensity (I) of the first component (RLp), with a reception angle of the at least one further means for detecting an intensity (I) being adjustable.

21. The device of claim 20 wherein a further component (RLs) can additionally be filtered out of the light reflected by the security element (4) with a polarisation at right angles to the first polarisation by way of the at least one means for polarisation filtering.

22. The device of claim 19 wherein a further component (RLs) can additionally be filtered out of the light reflected by the security element (4) with a polarisation at right angles to the first polarisation by way of the at least one means for polarisation filtering.

23. The method of claim 19, wherein an angle between a polarisation direction of the first component (RLp) and a reflection plane is selected as a characteristic polarisation angle, with the characteristic polarisation angle being at least dependent on the at least one illumination parameter and on the type of a substance (5) to be verified which has optically variable properties.

* * * * *